US009776786B2

(12) United States Patent
Nuijen et al.

(10) Patent No.: US 9,776,786 B2
(45) Date of Patent: Oct. 3, 2017

(54) ACTUATOR AND DISPENSING APPARATUS

(71) Applicant: Plasticum Netherlands B.V., Tilburg (NL)

(72) Inventors: Henricus Johannes Cornelius Nuijen, Linden (NL); Antonetta Johanna Maria Schoenmakers, Udenhout (NL); Hermanus Jacobus Vos, Waalwijk (NL)

(73) Assignee: Plasticum Netherlands B.V., Tilburg (NL)

( * ) Notice: Subject to any disclaimer, the term of this patent is extended or adjusted under 35 U.S.C. 154(b) by 27 days.

(21) Appl. No.: 14/763,545

(22) PCT Filed: Feb. 6, 2014

(86) PCT No.: PCT/NL2014/050073

§ 371 (c)(1),
(2) Date: Jul. 27, 2015

(87) PCT Pub. No.: WO2014/123417

PCT Pub. Date: Aug. 14, 2014

(65) Prior Publication Data

US 2016/0009478 A1 Jan. 14, 2016

(30) Foreign Application Priority Data

Feb. 7, 2013 (NL) ..... 2010273

(51) Int. Cl.
*B65D 83/20* (2006.01)
*B05B 1/34* (2006.01)

(52) U.S. Cl.
CPC ..... *B65D 83/205* (2013.01); *B05B 1/34* (2013.01); *B65D 83/20* (2013.01); *B05B 1/341* (2013.01)

(58) Field of Classification Search
CPC ..... B65D 83/14; B65D 83/20; B65D 83/205; B05B 1/34; B05B 1/341
See application file for complete search history.

(56) References Cited

U.S. PATENT DOCUMENTS

| | | | |
|---|---|---|---|
| 3,464,597 | A | 9/1969 | Kutik |
| 3,635,406 | A | 1/1972 | Scheindel |
| 3,785,571 | A | 1/1974 | Hoening |

(Continued)

FOREIGN PATENT DOCUMENTS

| | | |
|---|---|---|
| GB | 1170053 | 11/1969 |
| GB | 2475422 A | 5/2011 |

*Primary Examiner* — Ryan Reis
(74) *Attorney, Agent, or Firm* — Hoffmann & Baron, LLP

(57) ABSTRACT

An actuator for dispensing the liquid contents of a container in the form of a spray includes an actuator cap, an axial spray channel with an orifice for spraying the contents of the container, and an axial feed channel for connection a container outlet to the spray channel. A breakup wedge is provided in the feed channel such that it splits the feed channel into two sub channels, each connected via a side inlet opening with an inlet portion of the spray channel. Thus, in use, a flow of content is split into two sub flows by the breakup wedge, which sub flows subsequently collide in the inlet portion of the spray channel causing a turbulent flow of the liquid product in the inlet portion of the spray channel, which turbulent flow is guided by the spray channel towards and out of the dispensing opening.

13 Claims, 3 Drawing Sheets

(56) References Cited

U.S. PATENT DOCUMENTS

| | | | | | |
|---|---|---|---|---|---|
| 3,994,442 | A | | 11/1976 | Hoening | |
| 4,367,847 | A | | 1/1983 | Bayer | |
| 4,417,674 | A | * | 11/1983 | Giuffredi | B65D 83/48 222/402.18 |
| 5,411,177 | A | * | 5/1995 | Blake, III | B01F 3/04446 222/105 |
| 5,516,045 | A | | 5/1996 | Baudin | |
| 6,152,335 | A | * | 11/2000 | Stern | B05B 1/02 222/394 |
| 7,059,546 | B2 | * | 6/2006 | Ogata | B05B 1/262 222/190 |
| 9,296,549 | B2 | * | 3/2016 | Ghavami-Nasr | B65D 83/14 |
| 2001/0011687 | A1 | | 8/2001 | Benoist | |
| 2003/0082243 | A1 | * | 5/2003 | Harman | A61K 9/0019 424/600 |
| 2003/0089734 | A1 | * | 5/2003 | Eberhardt | B05B 1/00 222/39 |
| 2009/0050715 | A1 | | 2/2009 | Gidlow | |

* cited by examiner

ACTUATOR AND DISPENSING APPARATUS

CROSS-REFERENCE TO RELATED APPLICATIONS

This application is the National Stage of International Application No. PCT/NL2014/050073 filed Feb. 6, 2014, which claims the benefit of Netherlands Application No. 2010273, filed Feb. 7, 2013, the contents of which is incorporated by reference herein.

FIELD OF THE INVENTION

This invention relates to an actuator, and in particular to an actuator for dispensing liquid products in the form of a spray. The invention furthermore relates to a dispensing apparatus comprising such an actuator.

BACKGROUND OF THE INVENTION

Many liquid products are packaged in containers that include devices for dispensing the liquid product in the form of a spray. Such containers typically dispense the liquid product, under pressure, through a dispensing valve. For example, the liquid product may be stored under pressure in a sealed container fitted with a dispensing valve. Alternatively, the liquid product may be stored in a container fitted with a dispensing valve that includes pump devices for urging the liquid product though the dispensing valve under pressure.

In any case, however, some form of actuator is usually fitted to the container, often as a cap. The actuator includes devices for operating the dispensing valve and any associated pump device, and an outlet through which the product is dispensed as a spray. Conventional actuators generally comprise a feed channel leading to an outlet, the channel being in fluid communication with the dispensing valve. Generally, the user depresses the actuator to actuate the valve and any associated pump device, and hence dispense the product through the outlet of the actuator in the form of a spray.

It is very often desirable to form a spray comprising a fine mist of liquid droplets. Conventionally, therefore, a dispensing apparatus includes devices for atomizing the liquid product into small droplets before it is dispensed as a spray. A preferred method of atomizing the liquid product is by means of a flow-modifying insert that is fitted within the outlet of the actuator during manufacture. In use, the liquid product flows through the flow-modifying insert before exiting the outlet of the actuator as a spray. Typically, flow-modifying inserts act to form a vortex within the liquid product, which causes atomization of the liquid product and forms a spray comprising a fine mist of liquid droplets.

However, since the flow-modifying insert is generally of relatively complex structure, actuator caps including such flow-modifying inserts are conventionally manufactured as two components that are then assembled together on an assembly line. The presence of a flow-modifying insert therefore increases the cost of manufacture significantly.

SUMMARY OF THE INVENTION

The aim of the invention is to provide an alternative actuator, preferably with improved dispensing characteristics and which preferably overcomes or substantially mitigates the above-mentioned and/or other disadvantages associated with the prior art.

An actuator according to the invention is configured for actuating a dispensing valve of a container that stores a liquid product, which container is pressurized or has a pump, for dispensing the liquid contents of that container in the form of a spray. The actuator comprises an actuator cap, an axial feed channel, a breakup wedge, and an axial spray channel.

The actuator cap is a body made by injection moulding a plastic material. The actuator cap is a single component, comprising walls, stems etc. that shape and define the physical appearance of the actuator, the channels provided in the actuator and the break up wedge.

The axial feed channel has an inlet portion for connection to a container outlet to receive the pressurized contents of the container and extends in a feed direction. The feed direction is substantially similar to the longitudinal direction of the axial feed channel.

The breakup wedge is provided in the feed channel and extends in the feed direction such that the breakup wedge splits the feed channel into two sub channels. The two sub channels extend in the feed direction on opposite sides of the breakup wedge.

The axial spray channel has, at one end, an orifice for spraying the contents of the container. The axial spray channel extends in a spray direction, and intersects with the feed channel, more in particular with the two sub channels of the feed channel, such that the sub channels, each via a side inlet opening in an inlet portion of the spray channel, directly communicate with the spray channel.

With an actuator according to the invention, in use, a flow of content in the feed channel is split into two sub flows by the breakup wedge. The sub flows subsequently collide in the inlet portion of the spray channel causing a turbulent flow of the liquid product in the inlet portion of the spray channel, which turbulent flow is guided by the spray channel towards and out of the dispensing opening.

The dispensing apparatus according to the invention is advantageous principally because turbulent flow is formed in the liquid product, in use, without the need for a flow-modifying insert, or any other additional component. The dispensing apparatus may therefore comprise an actuator that is formed as a single component, thereby reducing manufacturing costs for such dispensing apparatus considerably. By "turbulent flow" is meant flow accompanied by sufficient forces to cause atomization of the liquid product as it traverses, and exits from, the outlet portion of the spray channel.

It has been found that achieving this effect by colliding two flows against each other is more efficient than using mechanical device for achieving a turbulent flow. Furthermore, creating the turbulent flow in the spray channel just prior to being sprayed proves more effective than creating the turbulent flow in the feed channel.

Furthermore, the breakup wedge extends in the feed channel in the flow direction. Also, the spray channel intersects with the feed channel, more in particular with the two sub channels of the feed channel, such that the spray channel is in direct communication with the sub channels via the side inlet openings. Thus, it is arranged that the two sub flows collide at optimal velocity in the spray channel attributing, in use, to an increase in the degree of atomization achieved by the apparatus according to the invention.

Furthermore, by providing the breakup wedge upstream of the spray channel, in practice there is no longer a flow trajectory along which a portion of the flow can flow from the feed channel into and out of the spray channel without colliding with the other part of the flow.

Furthermore, the configuration with a breakup wedge in combination with a spray channel intersecting the feed channel, and the breakup wedge provided therein, provides an actuator that can be made as a single component using a simple injection mould.

In an embodiment according to the invention, the width of the breakup wedge adjacent the spray channel is smaller than the diameter of the spray channel, preferably is almost similar to the diameter of the spray channel. Providing the breakup wedge with such dimensions allows for a maximal distance between the two sub flows, that still allows for direct entry of the sub flows into the spray channel. No additional conduits are needed for guiding the flows from the feed channel to the spray channel.

In an embodiment according to the invention, the width of the breakup wedge is at least 70% of the diameter of the spray channel, preferably is at least 80% of the diameter of the spray channel, for example is about 90% of the diameter of the spray channel preferably is about 95% of the diameter of the spray channel.

In an embodiment, the two side inlet openings have a longitudinal shape and extend in the circumferential direction of the spray channel. Thus the sub flows are provided with optimal access openings located in the inlet portion of the spray channel.

In an embodiment, the break up wedge is of substantially symmetrical design and comprises a virtual central plane, which central plane comprises a central axis of the spray channel, preferably the central axis of the spray channel and the central axis of the feed channel. Thus the breakup wedge is optimally positioned for guiding the sub flows towards the side inlet openings of the spray channel, i.e. both sub flows are provided with a similar flow trajectory of about the same length.

In an embodiment of an actuator according to the invention, the mechanical breakup wedge extends in the feed channel upstream of the spray channel, and the section of the spray channel intersecting with the breakup wedge such that, when seen in side view, the two side inlet openings in the spray channel form a through opening in the breakup wedge. Such a configuration is especially useful when the spray channel is intersects with the feed channel at some distance of the end of the feed channel. The breakup wedge thus extends towards the upper end of the feed channel and thus prevents the sub flows from colliding in the feed channel.

In an embodiment, the spray channel extends at an angle with the feed channel, which angle lies in the range of 45 to 135 degrees, for example in the range of 65 to 115 degrees, preferably in the range of 75 to 105 degrees, for example at an angle of about 85 degrees.

The breakup wedge as described above preferably is shaped as a wall of a substantially continuous cross section, extending from the wall adjacent the point at which the spray channel intersects the feed channel. In an embodiment, the mechanical breakup wedge tapers in the upstream direction, i.e. the direction opposite to the flow direction. Thus the sub flows are more gradually moved away from each other.

In an embodiment according to the invention, the breakup wedge has, when seen in the axial direction of the feed channel, a Y-shape or T-shaped cross section, and splits the feed channel in an additional third sub channel extending in the feed direction. In this embodiment, the axial spray channel intersects with the feed channel, more in particular with the three sub channels of the feed channel, such that the third sub channels, via an inlet opening at the end of the spray channel, i.e. the end opposite the end with the spray opening, directly communicates with the spray channel.

In this configuration, the stem of the Y-shape or T-shape extends parallel to the axis of the spray channel, such that the two sub flows entering the spray channel via the side inlet follow similar trajectories. Furthermore, the spray channel intersects with the breakup wedge all the way up to the point at which the three sections of the Y-shape or T-shape intersect. Thus, the end inlet opening provides direct communication between the spray channel and the third sub channel, similar to the direct communication provided by the two side inlet openings.

In this embodiment, three sub flows collide in the spray channel, of which one, entering via the end inlet opening, is directed towards the spray opening while the other two flows, entering via the side inlets, are more or less directed into each other. In this configuration, the outlet the spray tends to exit the spray channel at a higher speed compared to the configuration with two side channels only.

The invention furthermore provides a dispensing apparatus for dispensing a liquid product in the form of a spray, wherein the dispensing apparatus comprises a container for storing the liquid product and an actuator according to the invention. The container is provided with a dispensing valve having a valve outlet through which the liquid product is released under pressure, when actuated. The actuator is engaged with the dispensing valve such that the inlet portion of the axial feed channel is in communication with the valve outlet of said container.

The container and dispensing valve may together have the form of a conventional aerosol canister in which the liquid product is stored under pressure. Alternatively, the dispensing valve may include pump devices for urging the liquid product though the dispensing valve under pressure. In any case, however, the dispensing valve is usually actuated by depressing the valve outlet of the dispensing valve. The actuator component therefore preferably includes a recess for receiving an upper end of the valve outlet with a close fit, the recess being in communication with the inlet portion of the feed channel.

The present invention removes the need for a separate flow-modifying insert to form a vortex in the liquid product emerging from the exit aperture. The actuator component is therefore preferably formed as a single component, preferably by injection moulding of plastics material.

BRIEF DESCRIPTION OF THE DRAWINGS

The invention will now be described in greater detail, by way of illustration only, with reference to the accompanying drawings, in which.

DETAILED DESCRIPTION OF THE INVENTION

Figure 1:
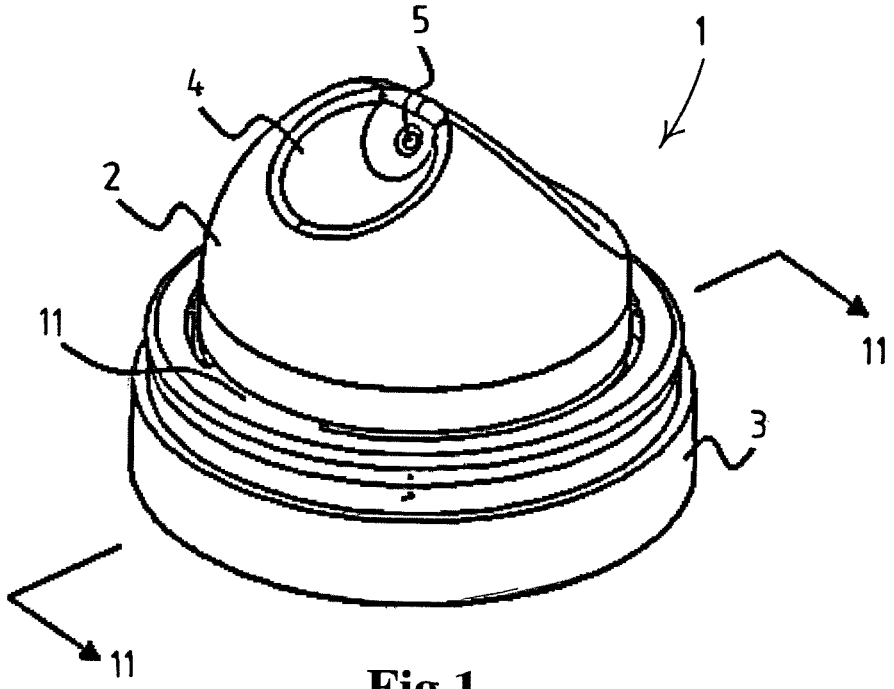
FIG. 1 is a perspective front view of an embodiment of an actuator according to the invention.
Figure 2:
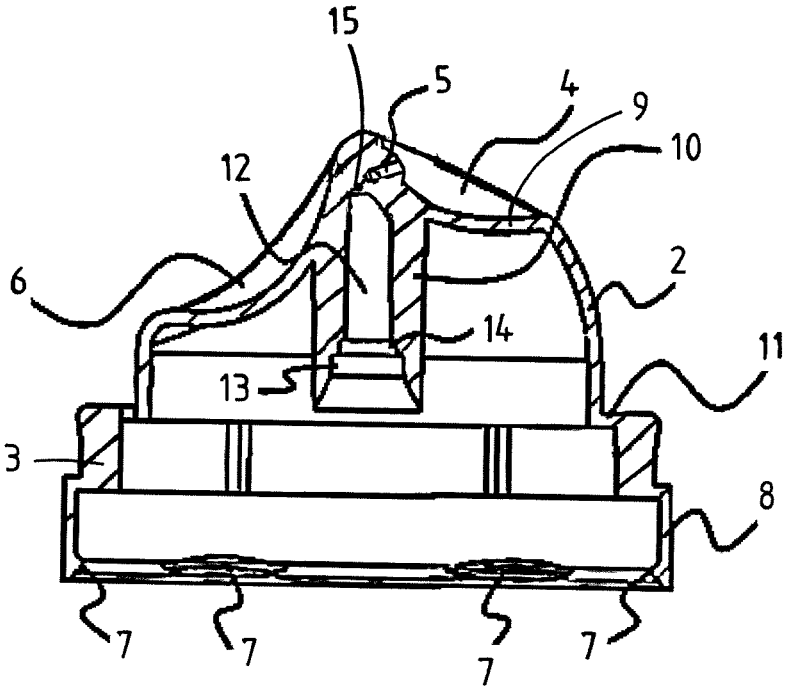
FIG. 2 is a cross-sectional view of the first embodiment along the line 11-11 in FIG. 1.
Figure 3:
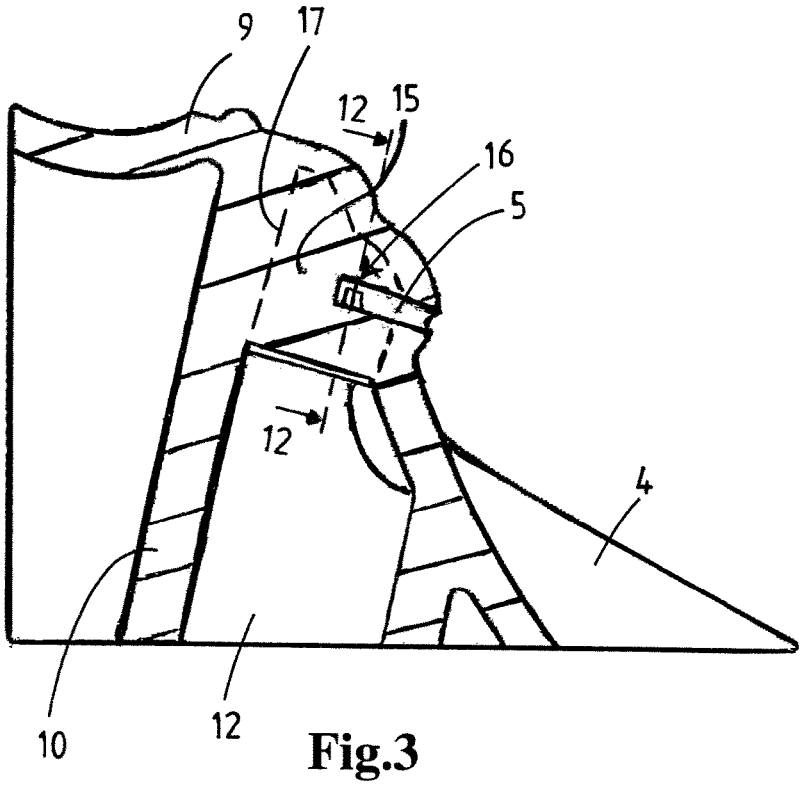
FIG. 3 is a close-up view of FIG. 2, showing breakup wedge and spray channel in more detail.

FIGS. 1 to 3 show an embodiment of an actuator 1 according to the invention. The actuator is formed as a single component cap of plastics material by injection moulding. The actuator cap is adapted to engage an aerosol canister (not shown in the Figures) comprising a sealed container that stores a liquid product under pressure, and a dispensing valve that, when actuated, allows the liquid product to exit the container through the valve. The actuator described below provides means for actuating the dispensing valve and forming a spray of liquid.

In the particular embodiment shown in FIGS. 1-2, the actuator 1 comprises an operable portion 2 that is hingeably connected to a base portion 3 for mounting the actuator cap 1 to an aerosol canister. The upper surface of the operable portion 2 comprises a front concave portion 4 into which the outlet conduit 5 opens and hence from which the spray is emitted, and a rear concave portion 6 suitable for a user to impart a downward force (as viewed in FIGS. 1 and 2) on the actuator, in use, to depress the valve stem, as described in more detail below.

As shown most clearly in FIG. 2, the actuator base portion 3 has an outer wall 8 that is generally cylindrical in shape, with an open base and an opening at its top end. The base portion 3 is thus generally annular in shape. It includes projections 7 at the lower end of its interior surface that enable it to engage a peripheral rim of the aerosol canister with a snap fit. The operable portion 2 comprises an upper wall 9 which forms a closed upper end of the actuator. The operable portion 2 is mounted within the upper opening defined by the base portion 3, and is attached to the base portion 3 at its front end, i.e. the end towards which the spray is directed, by a neck 11.

The aerosol canister, with which the actuator cap is intended to be used, comprises a dispensing valve having a tubular valve stem extending upwardly from an upper surface of the aerosol canister. The dispensing valve is configured such that depression of the valve stem will cause the liquid product to flow, under pressure, out of the canister through the valve stem.

In the actuator 1, a central stem 10, with a cylindrical exterior surface, extends co-axially with the outer wall 8 from the upper wall 9 to the base of the actuator 1. The interior of the central stem defines a feed channel 12 that extends from the base of the actuator to a position adjacent to the upper wall. The feed channel comprises a funnel portion (as viewed in FIG. 2) of gradually reducing width, the funnel portion leading into a cylindrical receiving portions 13, 14 adapted to receive the upper end of a valve stem with a close fit. By providing an upper and lower receiving portions 13,14 having different diameters, the operable portion is able to engage valve stems having a different diameters. The upper cylindrical receiving portion 14 leads into the generally cylindrical feed channel 12 of reduced diameter. A shoulder is formed between the cylindrical receiving portion 14 and the feed channel 12 of reduced diameter such that the upper end of the valve stem abuts this shoulder when engaged with the actuator cap.

The feed channel 12 terminates at its upstream end at the upper wall 9 of the actuator 1. At the upper end of the feed channel 12 a mechanical breakup wedge 15 is provided, which extends across the feed channel 12. In FIG. 2, the breakup wedge extends parallel to the plane of the drawing. The breakup wedge 15 thus effectively divides the feed channel into two sub channels. It is noted that the feed channel not ends at the breakup wedge, but extends on opposite sides thereof. In the FIG. 2 one of the sub channels extends behind the breakup wedge shown in cross section.

It is noted that in the embodiment shown, the breakup wedge is of an essentially symmetrical design and thus comprises a virtual central plane, which central plane comprises a central axis of the spray channel.

The feed channel of an actuator according to the invention is preferably tubular in form, and is most preferably generally cylindrical. The longitudinal axis of the feed channel preferably is coincidental with the direction of flow of the product during use. The breakup wedge of an actuator according to the invention forms a wall extending into the feed channel.

The break up wedge 14 extends along the longitudinal axis of the feed channel, and hence, in use, the direction of liquid flow in the feed channel 12. Thus, in use, the liquid flow is split by the breakup wedge 15 into two sub flows on opposite sides of the breakup wedge. However, since the breakup wedge extends in the flow direction, the impact of this on the flow is minimal. The flow maintains its velocity.

The cylindrical spray channel 5 is provided near the top of the actuator 1. In the embodiment shown, the spray channel 5 is orientated such that its longitudinal axis extends at an angle to the longitudinal axis of the feed channel 12. At its downstream end, the spray channel 5 ends in a spray opening for dispensing a spray.

The spray channel of an actuator according to the invention is preferably tubular in form, and is most preferably generally cylindrical. The side entrance apertures are preferably substantially circular, or elliptical, in shape. The length of the spray channel is selected depending upon the desired spray characteristics. In an embodiment, the outlet portion of the spray channel, i.e. the downstream end portion that guides the combined sub flows to the spray opening, is provided with gradually increasing cross-sectional dimensions that lead to a spray opening of increased cross-sectional area relative to the cross section of the upstream part of the spray channel.

The spray channel 5 intersects with the breakup wedge 15 in the feed channel 12, such that the spray channel is provided with two side inlet openings 16 (of which one is shown in FIGS. 2 and 3) via which the spray channel and the feed channel, more in particular the sub channels of the feed channel on opposite sides of the breakup wedge, are in direct communication. Thus, there are no additional conduits connecting the feed channel with the spray channel, and hence, in use, the liquid flow flows directly from the spray channel into the feed channel. Therefore, the flow maintains optimal velocity.

It is noted that the inlet openings are located on opposite sides of a virtual plane comprising a central axis of the spray channel.

The actuator 1 described above is fitted to an aerosol canister by inserting the upper end of the valve stem, with a close fit, into the cylindrical receiving portion 14 (or 13) of the central stem 10. When the actuator cap and aerosol canister are engaged with one another, the upper end of the valve stem abuts the shoulder formed between the cylindrical receiving portion 14 and the feed channel 12 of the main stem 10.

When a user wishes to dispense the liquid product, the user will depress the rear concave portion 6 of the operable portion 2, thereby causing the operable portion 2 to pivot downwards about the neck 11. Pivoting of the operable portion 2 downwards about the neck 11 will cause the valve stem that is engaged with the upper or lower receiving portion 14,13 to become depressed. The liquid product will then flow, under pressure, through the valve stem and into the feed channel 12 of the actuator 1. The liquid flow, when reaching the top end of the feed channel 12, will there be split into two sub flows by the breakup wedge 15. The liquid product flows will then enter the inlet portion spray channel 5, i.e. the portion provided with the side inlets, from opposite sides, and collide with each other in said spray channel. The substantially head on collision of the flows in the spray channel causes a turbulent flow, and thus atomization of the liquid product such that a spray comprising a fine mist of liquid droplets exits the spray channel. The liquid product will then be emitted as a spray through the spray opening of the spray channel 5 formed in the outer wall 9.

FIG. 3 shows in close up the spray channel 5 intersecting with the feed channel 12 and the breakup wedge 15 in cross section. In this figure also the side inlet opening 16 that provides direct communication between the spray channel 5 and the sub channel extending behind the breakup wedge 15 is also visible. In dotted lines 17 the contour of the sub channel behind the breakup wedge is indicated.

Figure 4:
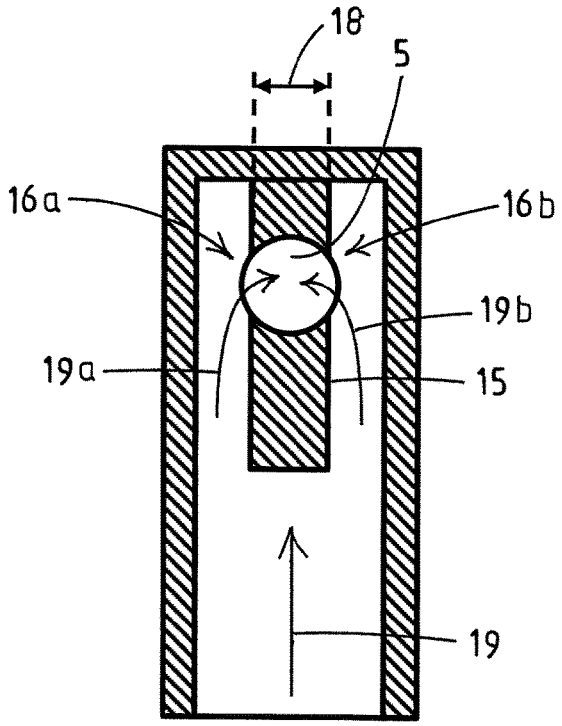
FIG. 4 is a schematic cross sectional view of the breakup wedge along the line 12-12 in FIG. 2.

FIG. 4 shows highly schematic cross sectional view of the breakup wedge along the lined 12-12 in FIG. 2. In this figure the width of the breakup wedge is indicated with arrow 18. From the Fig. it is clear that in the embodiment shown, the width of the breakup wedge is a bit smaller than the diameter of the flow channel.

Furthermore, in the Fig. it is indicated with arrows 19A and 19B how the two sub flows enter the spray channel from opposite sides through the side inlet openings 16A and 16B respectively. In the embodiment shown, the breakup wedge extends in the upper part of the feed channel 12 to prevent the sub flows form colliding in that part of the feed channel.

It is furthermore observed that the part of the mechanical break up wedge 15 that extends in the feed channel from the spray channel 5 downwards, has a length in the feed direction that is larger than the diameter of the spray channel. Thus, the sub flows 19A and 19B travel through the sub channels 16A and 16B respectively over a distance larger than the diameter of the spray channel 5.

It is noted that different parts of the actuator may be varied so as to alter the characteristics of the spray formed. For example, the length of the spray channel and the shape of its cross section may be varied to alter the characteristics of the spray formed.

Furthermore, in the embodiment sown, the breakup wedge extends across the entire feed channel, form the wall part with the spray channel provided in it to the opposite wall part. In an alternative embodiment, the breakup wedge extends from the wall part with the spray channel provided in it, but does not extend up to said opposite wall, but only up to for example half or two third of the feed channel. Although such a breakup wedge does not fully split the feed channel, it does still split the flow of content towards the side inlet openings of the spray channel.

In the embodiment shown, the actuator was provided with a base portion 3 and an operable part 2. It is noted however, that he invention can be implemented with other types of actuators as well, for example actuators that do not engage the canister and thus comprise only an operable portion, and not a base portion.

In a further embodiment according to the invention, rows of side inlet openings are provided on opposite sides of the spray channel, each row of side openings providing a direct connection between a sub channel and the spray channel.

Figure 5:
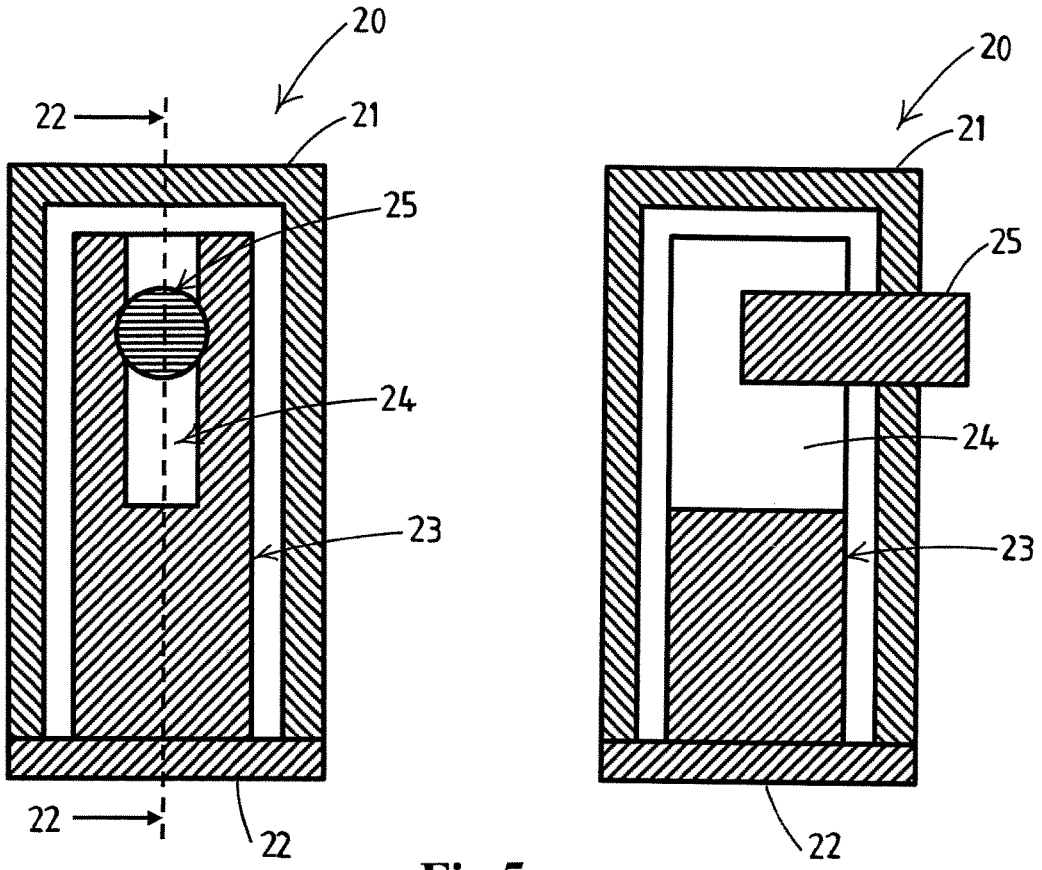
FIG. 5 is a schematic side view and frontal view of a injection mould for providing an actuator according to the invention.

In a further embodiment according to the invention, the feed channel is provided with a central stem, the stem extending from the top wall into the feed channel, which stem has a diameter larger than the width of the breakup wedge. Such an embodiment is shown in FIG. 5, which shows the breakup wedge seen from the feed channel inlet looking upwards into the feed channel. In a further embodiment, the breakup wedge extends from the side wall comprising the spray channel up to the central stem in the feed channel. In this embodiment the stem forms the end of the breakup wedge.

The configuration of an actuator according to the invention allows for providing the actuator as a single component by way of injection moulding, and furthermore allows for providing the actuator with a comparatively simple injection mould, i.e. an injection mould with only a limited number of moving elements. FIG. 5 shows a schematic side view and front view in cross section of an injection mould 20 for providing an actuator according to the invention. The side view, shown right in the figure, is a cross sectional view along the line 22-22.

The injection mould comprises a female part 21 for defining the outside shape of the actuator, and a male part 22 for defining the inside shape of the actuator. Since the breakup wedge extends in the flow direction, the male part can define the shape of the feed channel and the breakup wedge. Therefore, the male part is provided with a stem element 23 for forming the feed channel, in which a cut away 24 is provided that defines the single, wall shaped, breakup wedge.

The female part 21 is provided with a sliding pin 25, which during the injection moulding process extends into the feed channel and breakup wedge. Therefore, the stem element is provided with cut ways for receiving sliding pin 25, which is clearly visible in the frontal view in cross section.

It is observed that the injection mould is highly simplified for explanatory reasons. In the embodiment shown the actuator is more or less reduced to the to feed channel comprising the breakup wedge. Any additional wall, such as an outside wall, etc, are not shown. Furthermore, in practice, additional sliding elements can be provided for providing the actuator with additional features.

Figure 6:
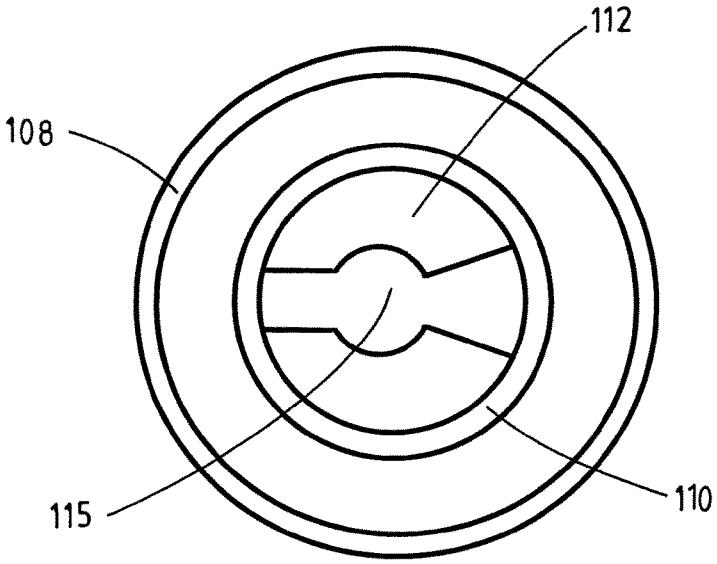
FIG. 6 is an alternative embodiment of a breakup wedge, seen from the inlet of the feed channel, according to the invention.

FIG. 6 is an alternative embodiment of a breakup wedge, seen from the inlet of the feed channel, according to the invention. FIG. 6 depicts a schematic bottom view of an actuator, which shows an outer wall 8, a central stem 110 with a feed channel 112 and a mechanical break up wedge 115 provided in that feed channel. The mechanical break up wedge 115 divides the feed channel 112 into two sub channels, one on each side of the mechanical break up wedge.

The invention claimed is:

1. An actuator for actuating a dispensing valve of a container that stores a liquid product, which container is pressurized or has a pump, for dispensing in a spray direction the liquid contents of that container in the form of a spray, wherein the actuator is formed as a single component by injection molding of plastics material, the actuator comprising:

an actuator cap;

an axial feed channel having an inlet portion for connection to a container outlet to receive the pressurized contents of the container, wherein the axial feed channel has a central axis that extends in a feed direction, a breakup wedge provided in the feed channel and extending in the feed direction such that the breakup wedge splits the feed channel into two sub channels, for in use splitting a flow of liquid content in the feed channel into two sub flows, the two sub channels extending in the feed direction on opposite sides of the breakup wedge, and an axial spray channel, wherein the axial spray channel has a central axis that extends in the spray direction, and at an angle with the central axis of the feed channel, which angle lies in the range of 45 to 135 degrees, from an inlet portion to an outlet portion of the spray channel, at which outlet portion the axial spray channel has an orifice for spraying the contents of the container, wherein the axial spray channel at the inlet portion intersects with the two sub channels of the feed channel and the breakup wedge, and the sub channels each directly communicate with the spray channel via a side inlet opening in the inlet portion of the spray channel, wherein the side inlet openings are located on opposite sides of a virtual plane that comprises the central axis of the spray channel, and wherein the side inlet openings are separated from each other by the break up wedge, such that in use the sub flows of liquid product enter the inlet portion of the spray channel from opposite sides and collide in a head on collision in the inlet portion of the spray channel, the head on collision creating a turbulent flow of the liquid product which causes atomization of the liquid product into a spray comprising a fine mist of liquid droplets, wherein the spray is guided by the spray channel, along its central axis, towards and out of the orifice for spraying the contents of the container at the outlet portion of the spray channel.

2. The actuator according to claim 1, wherein the width of the breakup wedge adjacent the spray channel is smaller than the diameter of the spray channel.

3. The actuator according to claim 2, wherein the width of the breakup wedge is at least 70% of the diameter of the spray channel.

4. The actuator according to claim 1, wherein in the two side inlet openings have an elongated shape and extend in the circumferential direction of the spray channel.

5. The actuator according to claim 1, wherein the break up wedge comprises a virtual central plane, which central plane comprises a central axis of the spray channel.

6. The actuator according to claim 1, wherein the breakup wedge extends in the feed channel upstream of the spray channel, and wherein in the section of the spray channel intersecting with the breakup wedge, when seen in side view, the two side inlet openings in the spray channel form a through opening in the breakup wedge.

7. The actuator according to claim 1, wherein the breakup wedge in cross section has a Y-shape or T-shape, and splits the feed channel in an additional third sub channel, extending in the feed direction, and wherein the axial spray channel intersects with the two sub channels and the third sub channel of the feed channel, wherein the third sub channel, via an inlet opening at an end of the spray channel opposite the end of the spray channel with the spray opening, directly communicates with the spray channel.

8. A dispensing apparatus for dispensing a liquid product in the form of a spray, wherein the dispensing apparatus comprises:

a container for storing the liquid product, which container is provided with a dispensing valve having a valve outlet through which the liquid product is released under pressure, when actuated, and an actuator according to claim 1, which actuator is engaged with the dispensing valve such that the inlet portion of the axial feed channel is in communication with the valve outlet of said container.

9. The dispensing apparatus as claimed in claim 8, wherein the container and dispensing valve together have the form of a conventional aerosol canister in which the liquid product is stored under pressure.

10. The dispensing apparatus as claimed in claim 8, wherein the dispensing valve includes pump device for urging the liquid product though the dispensing valve under pressure.

11. The dispensing apparatus as claimed in claim 8, wherein the dispensing valve is actuated by depressing the valve outlet of the dispensing valve.

12. The dispensing apparatus as claimed in claim 11, wherein the actuator includes a recess for receiving an upper end of the valve outlet with a close fit, the recess being in communication with the inlet portion of the feed channel.

13. An injection mould for providing an actuator according to claim 1.

* * * * *